United States Patent [19]

Müller

[11] Patent Number: 4,585,227

[45] Date of Patent: Apr. 29, 1986

[54] APPARATUS FOR SUBDIVIDING A STREAM OF PARTIALLY OVERLAPPING PAPER SHEETS

[75] Inventor: Hans Müller, Zofingen, Switzerland

[73] Assignee: Grapha-Holding AG, Hergiswil, Switzerland

[21] Appl. No.: 610,405

[22] Filed: May 15, 1984

[30] Foreign Application Priority Data

May 17, 1983 [CH] Switzerland ..... 2673/83

[51] Int. Cl.[4] ..... B65H 5/24; B65G 47/26

[52] U.S. Cl. ..... 271/270; 271/202; 271/69; 198/425; 198/365; 198/369; 198/435; 198/437; 198/461

[58] Field of Search ..... 271/202, 203, 270, 69, 271/302, 303; 198/425, 418, 432, 433, 362, 365, 366, 369, 435, 436, 437, 454, 460, 461

[56] References Cited

U.S. PATENT DOCUMENTS

| | | | |
|---|---|---|---|
| 3,194,382 | 7/1965 | Nigrelli et al. | 198/461 |
| 3,368,660 | 2/1968 | Standley et al. | 198/461 |
| 3,661,242 | 5/1972 | Clancy | 198/423 |
| 3,791,269 | 2/1974 | Sawada | 271/202 |
| 4,238,024 | 12/1980 | Hirakawa et al. | 198/428 |

FOREIGN PATENT DOCUMENTS

| | | | |
|---|---|---|---|
| 2713895 | 3/1977 | Fed. Rep. of Germany | 198/425 |
| 2037714 | 7/1980 | United Kingdom | 271/202 |

*Primary Examiner*—Bruce H. Stoner, Jr.
*Assistant Examiner*—James E. Barlow
*Attorney, Agent, or Firm*—Peter K. Kontler

[57] ABSTRACT

A continuous scalloped stream of paper sheets is divided into a succession of discrete sections by an accelerating device in cooperation with one or more belt conveyors which receive the sections. The accelerating device has an elongated rubber pad attached to an endless chain conveyor which can move the pad into the path of movement of the stream of sheets toward the belt conveyor or conveyors. The belt conveyor(s) and the chain conveyor are accelerated from the speed of the advancing stream to a higher second speed as soon as the trailing end of the section which is about to be separated from the stream is engaged by the trailing end of the pad on the chain conveyor. The chain conveyor and the belt conveyor(s) are decelerated back to the speed of the stream as soon as the entire freshly formed section is transferred onto the belt conveyor(s) and before the fresh leader of the stream reaches the discharge end of the conveyor for the stream. The acceleration of sheets which are to form successive sections to a speed exceeding the speed of the stream prevents the accumulation of piles of overlapping sheets at the leader of the stream upon separation of a section therefrom.

14 Claims, 5 Drawing Figures

APPARATUS FOR SUBDIVIDING A STREAM OF PARTIALLY OVERLAPPING PAPER SHEETS

CROSS-REFERENCE TO RELATED CASE

Certain parts of the apparatus which are disclosed in the present application are similar to those of the apparatus which are disclosed in the commonly owned copending patent application Ser. No. 610,400 filed May 15, 1984 by Hans Müller for "Apparatus for changing the direction of transport of discrete streams of paper sheets or the like".

BACKGROUND OF THE INVENTION

The present invention relates to apparatus for manipulating a stream of sheets, especially a scalloped stream of partially overlapping paper sheets. More particularly, the invention relates to improvements in apparatus for separating discrete sections or shorter streams from a continuous stream of paper sheets or the like.

It is well known to subdivide the leader of a continuous scalloped stream of paper sheets into a succession of shorter streams or sections which are then subjected to further treatments, such as stacking into piles, gathering into signatures or the like. As a rule, the continuous stream is transported by a first conveyor which is driven at a given speed, and successive sections which are separated from its leader are transferred onto a second conveyor whose length at least matches that of a separated section. Each such section can be delivered into one of the magazines in a gathering machine or the like. As a rule, separation of discrete sections from the leader of the continuous stream is effected by resorting to an intercepting device which penetrates into the stream at certain intervals to temporarily prevent further forward movement of the sheets at its upstream side but to allow further forward movement of the sheets which constitute the thus separated section. This invariably entails the development of a pileup of a certain number of sheets immediately upstream of the intercepting device where the intercepted sheets accumulate into a stack which can present problems during further processing, i.e., subsequent to retraction of the intercepting device. A proposal to eliminate the development of stacks upstream of the intercepting device, whenever the latter is caused to penetrate into the stream, is disclosed in German Offenlegungsschrift No. 30 35 495. This publication proposes the formation of a small stack in response to alternate penetrations of the intercepting device into the continuous stream of partly overlapping sheets with attendant reduction of the frequency of problems which are likely to arise as a result of the accumulation of such stacks. This solution is evidently a stop-gap measure because it does not eliminate the aforediscussed problem but merely reduces the frequency of its development whereby the reduction of frequency is of little value when the stream is transported at an elevated speed so that the making of discrete sections must take place at rapidly recurring intervals.

OBJECTS AND SUMMARY OF THE INVENTION

An object of the invention is to provide a novel and improved apparatus for subdividing a continuous stream of paper sheets or the like into shorter streams or sections in such a way that the sheets immediately following a freshly separated section cannot and do not accumulate into piles irrespective of the frequency of formation of discrete sections.

Another object of the invention is to provide an apparatus which can be resorted to for subdivision of a continuous stream of partly overlapping or non-overlapping sheets, which can be utilized in connection with the subdivision of a stream which consists of large, small, heavy, lightweight, stiff or readily flexible sheets, which can be used for the subdivision of a stream into sections containing identical or different numbers of sheets, and which can be resorted to in connection with the transport of discrete sections of a continuous stream to any one of a wide variety of processing stations.

A further object of the invention is to provide an apparatus which can be utilized to separate as well as to change the direction of movement of each separated section at a frequency which is sufficiently high to satisfy the requirements of modern highspeed processing machines.

A further object of the invention is to provide an apparatus which can be rapidly converted for the separation of shorter or longer sections from a continuous stream of partially overlapping or non-overlapping sheets, which occupies little room, and which can be designed to transport the separated sections away in any desired direction including counter to the direction of transport of the stream.

Still another object of the invention is to provide an apparatus which can dispense with the aforediscussed conventional intercepting device to thus prevent the accumulation of stacks of sheets behind the trailing ends of freshly separated sections.

The invention resides in the provision of an apparatus for separating discrete sections of selected length from the leader of a stream of sheets, particularly from a continuous stream of partially overlapping paper sheets. The apparatus comprises a first conveyor means which is arranged to advance the stream in a predetermined direction along a first elongated path and has a discharge end, second conveyor means which defines at least one second elongated path and has a receiving end downstream of the discharge end of the first conveyor means, as considered in the predetermined direction, accelerating means which is adjacent to a portion of the first path ahead of the discharge end and is arranged to repeatedly accelerate those portions of the leader of the stream in the first path whose length matches the selected length, first drive means for moving the first conveyor means at a first speed, and second drive means for alternatively moving (a) the second conveyor means and the accelerating means in the predetermined direction at a higher second speed so that the accelerating means separates the portion of the leader of the stream in the first path from the remainder of the stream and advances the thus obtained section into the second path where the section is advanced by the second conveyor means, and (b) the second conveyor means at a third speed which is lower than the second speed with attendant deceleration of the section in the second path. The third speed can equal or approximate the first speed and the second drive means is preferably arranged to move the accelerating means at the third speed jointly with the second conveyor means. The length of the second path preferably matches or exceeds the selected length of a section.

The accelerating means can comprise an endless conveyor having an elongated stream-contacting portion or reach adjacent to the aforementioned portion of the first path. The first conveyor means can also comprise an endless conveyor having an elongated portion or reach which defines the first path. Such reach preferably includes a portion which extends along and is parallel to the reach of the endless conveyor of the accelerating means.

The endless conveyor of the accelerating means can comprise a portion which extends into the first path while advancing along the aforementioned portion of the first path to thereby engage and entrain the adjacent sheets of the stream. The second drive means is then arranged to move the endless conveyor of the accelerating means at the second speed when the entire portion of the endless conveyor of the accelerating means enters the aforementioned portion of the first path.

The second conveyor means can define two second paths and can further comprise switching means which is interposed between the first and second paths and is movable between a first position in which a section advances therealong and into one of the second paths and a second position in which a section advances therealong and into the other of the second paths. The length of each second path at least matches the selected length of a section. The just discussed second conveyor means can comprise two discrete conveyors each of which defines one of the two second paths, and such apparatus then further comprises means for selectively coupling the second drive means to one conveyor of the second conveyor means at a time.

The apparatus can further comprise third conveyor means for diverting discrete sections from the second path into a third path and for moving the diverted sections along the third path in a second direction at least substantially at right angles to the predetermined direction. The third conveyor means can comprise means for moving a portion of the second conveyor means in the second direction. Such apparatus can further comprise fourth conveyor means for moving diverted sections along a fourth path in a third direction at least substantially counter to the predetermined direction. The fourth conveyor means can comprise means for gripping the sheets of sections in the fourth path.

At least the first path is preferably (but not necessarily) a horizontal path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
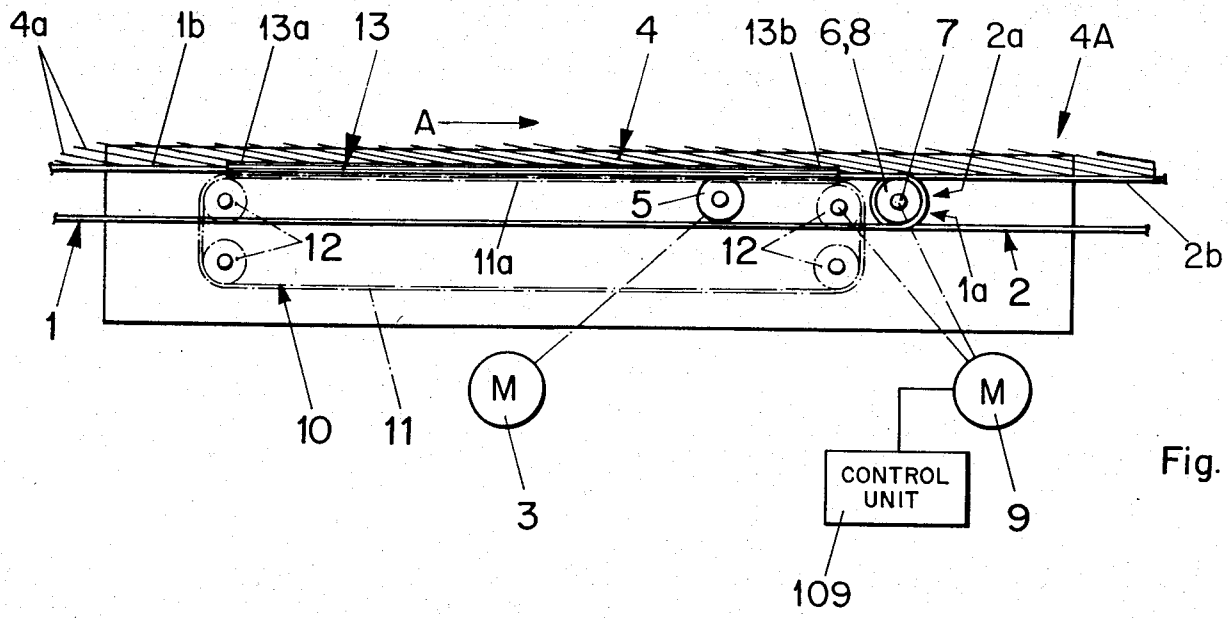
FIG. 1 is a schematic elevational view of an apparatus which embodies one form of the invention and wherein the means for receiving successive sections comprises a singe conveyor.

Referring first to FIG. 1, there is shown an apparatus which serves to subdivide a continuous scalloped stream 4 of partially overlapping paper sheets 4*a* into a series of discrete sections 4A of selected length. The apparatus comprises a first conveyor 1 which is an endless band or belt conveyor and whose discharge end 1*a* is adjacent to the receiving end 2*a* of a second endless belt or band conveyor 2. The first conveyor 1 is driven by a first motor 3 at a constant first speed M1 by way of a driven pulley 5 so that the major portion of the scalloped stream 4 continuously advances in a direction to the right, as viewed in FIG. 1 (note the arrow A), at the speed M1. The discharge end 1*a* of the conveyor 1 is defined by one or more pulleys 6 which are freely rotatable about the axis of a horizontal shaft 7. The upper reach 1*b* of the conveyor 1 defines for the stream 4 an elongated horizontal path wherein the sheets 4*a* of the stream 4 advance in the direction which is indicated by the arrow A.

The second conveyor 2 is driven by a second motor 9 which transmits torque to the shaft 7. The latter carries one or more driven pulleys 8 for the endless flexible element of the conveyor 2, and the upper reach 2*b* of such element defines a second elongated path which is a continuation of the first path and serves for reception of discrete sections 4A of the stream 4. Each of the conveyors 1, 2 can comprise a plurality of endless flexible elements which are disposed in vertical planes and alternate with one another, as considered in a direction at right angles to the plane of FIG. 1.

The apparatus of FIG. 1 further comprises an accelerating device 10 which comprises an endless chain conveyor 11 trained over four sprocket wheels 12 and having an upper reach 11*a* which is adjacent and parallel to the upper reach(es) of the endless flexible element(s) of the first conveyor 1. One of the sprocket wheels 12 can be driven by the motor 9 at a second speed M2 which exceeds the first speed M1, or at the speed M1. The length of the upper reach 11*a* of the chain 11 matches or only slightly exceeds the length of a section 4A. The difference between the length of a section 4A and the length of the upper reach 11*a* of the chain conveyor 11 equals the desired spacing between successive sections 4A. As can be seen in FIG. 1, the chain 11 carries a flexible elastic portion in the form of a rubber pad or cushion 13 which extends into the first path when it advances with the upper reach 11*a* so that it can frictionally engage and entrain the sheets 4*a* of an incipient section 4A in order to accelerate such sheets from the speed M1 to the speed M2 and to thereby separate from the leader of the stream 4 a complete section 4A of selected length. The thickness of the pad 13 and the level of the upper reach 11*a* of the chain conveyor 11 are selected in such a way that the pad 13 invariably extends into the first path which is defined by the upper reach 1*b* of the conveyor 1 while such pad advances in the direction which is indicated by the arrow A.

The motor 9 is a variable-speed motor and is connected with a control unit 109 which can vary its speed between M1 and M2. When the apparatus of FIG. 1 is in actual use, the motors 3 and 9 are first driven at the same (first or lower) speed M1. Thus, the speed of the upper reach 1*b* of the conveyor 1 then matches the speed of the conveyor 2 and also the speed of the chain conveyor 11, and the upper reaches 1*b*, 2*b*, 11*a* advance in the same direction (arrow A). This is denoted by the portion 50*a* of the composite curve of FIG. 5 wherein the speed (V) in meters per second is measured along the ordinate and the time T (in seconds) is measured along the abscissa. At the instant $t_1$, the control unit 109 begins to increase the speed of the motor 9 from M1 to M2. Prior to such acceleration of the conveyors 2 and 11, the leader of the continuous stream 4 advances with the upper reaches 1*b*, 2*b* of the conveyors 1 and 2, i.e., from the first path into and along the second path. At such time, the pad 13 of the conveyor 11 is remote from the corresponding portion of the upper reach 1*b* of the conveyor 1. The control unit 109 can be actuated by hand or automatically and changes the speed of the motor 9 from M1 to M2 when the trailing end 13*a* of the rubber pad 13 rises to the level of and enters the first path which is defined by the upper reach 1*b* of the conveyor 1. At such time, the leader 13*b* of the pad 13 is closely adjacent to the discharge end 1*a* of the conveyor 1. Acceleration of the motor 9 to the speed M2 entails a separation of a certain number of sheets 4*a* from the remaining portion of the stream 4, namely a separation of those sheets which are then located on the upper reach 2*b* of the conveyor 2 and on the pad 13 of the chain conveyor 11. The speed of the motor 9 is reduced back to M1 when the trailing end of the freshly formed section 4A has advanced beyond the discharge end 1*a* of the conveyor 1, i.e., when the trailing end of such section 4A is located on the upper reach 2*b* of the conveyor 2.

Figure 5:
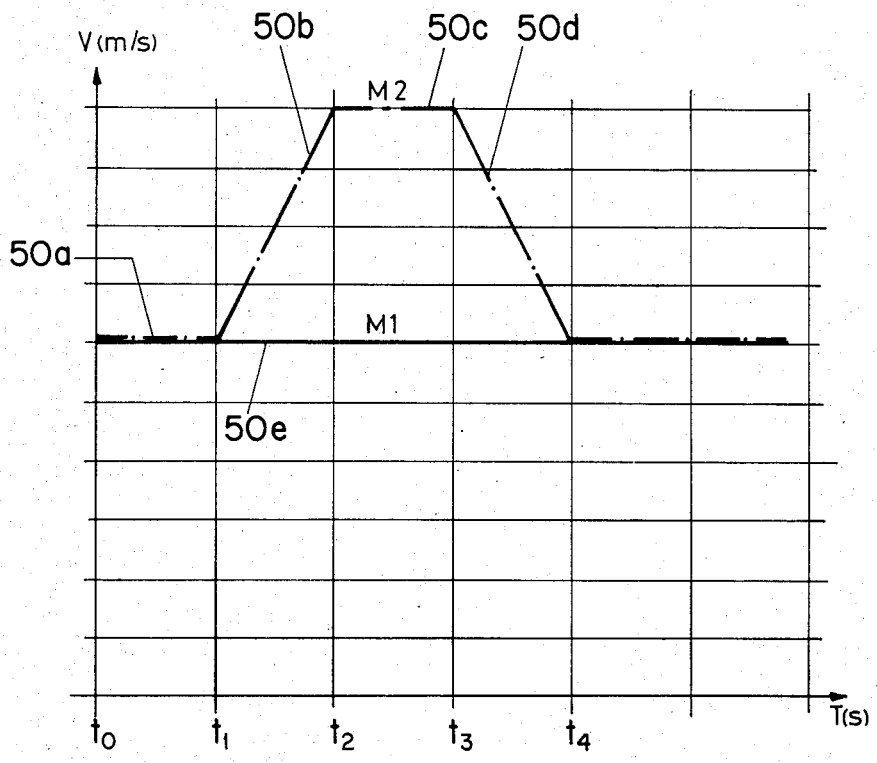
FIG. 5 is a velocity diagram showing changes in the speed of certain conveyors in the improved apparatus.

FIG. 5 shows that the acceleration of the motor 9 from the speed M1 to the speed M2 takes place between the instants $t_1$ and $t_2$ (curve portion 50*b*), that the motor 9 is driven at the speed M2 between the instants $t_2$ and $t_3$ (curve portion 50*c*), and that the motor 9 is decelerated from the speed M2 to the speed M1 during the interval between the instants $t_3$ and $t_4$ (curve portion 50*d*). The curve portion 50*e* denotes the unchanged speed M1 of the conveyor 1 between the instants $t_1$ and $t_4$.

The speed of the conveyors 11 and 2 is reduced to M1 at the instant $t_4$ so that the leader of the remaining part of the stream 4 is then free to advance over the upper reach 11*a* of the chain conveyor 11 (while the pad 13 is remote from such upper reach) and onto the upper reach 2*b* of the conveyor 2. The motor 9 is accelerated to the speed M2 as soon as the entire pad 13 returns into the first path which is defined by the upper reach 1*b* of the conveyor 1, and this starts the making of a second section 4A whose sheets 4*a* are separated from the remainder of the stream 4. The motor 9 is decelerated to the speed M1 as soon as the trailing end of the freshly formed section 4A is transferred onto the upper reach 2*b* of the conveyor 2. The same procedure is repeated again and again, as long as the motors 3 and 9 are running and as long as the supply of sheets 4*a* forming the stream 4 is not exhausted. It will be noted that the speed of sections 4A on the conveyor 2 varies between M1 and M2 but that the separation of such sections from the stream 4 does not result in the accumulation of aforediscussed piles or stacks because the improved apparatus need not employ a mechanical intercepting device and the speed of sheets 4*a* forming the stream 4 is never reduced below M1.

The sections 4A on the second conveyor 2 are separated from one another by gaps whose width depends on the difference between the speeds M1, M2, on the length of the pad 13 and on certain other parameters. Such discrete sections 4A are then delivered to one or more processing stations, such as to a newspaper stuffing machine.

Figures 2, 3:
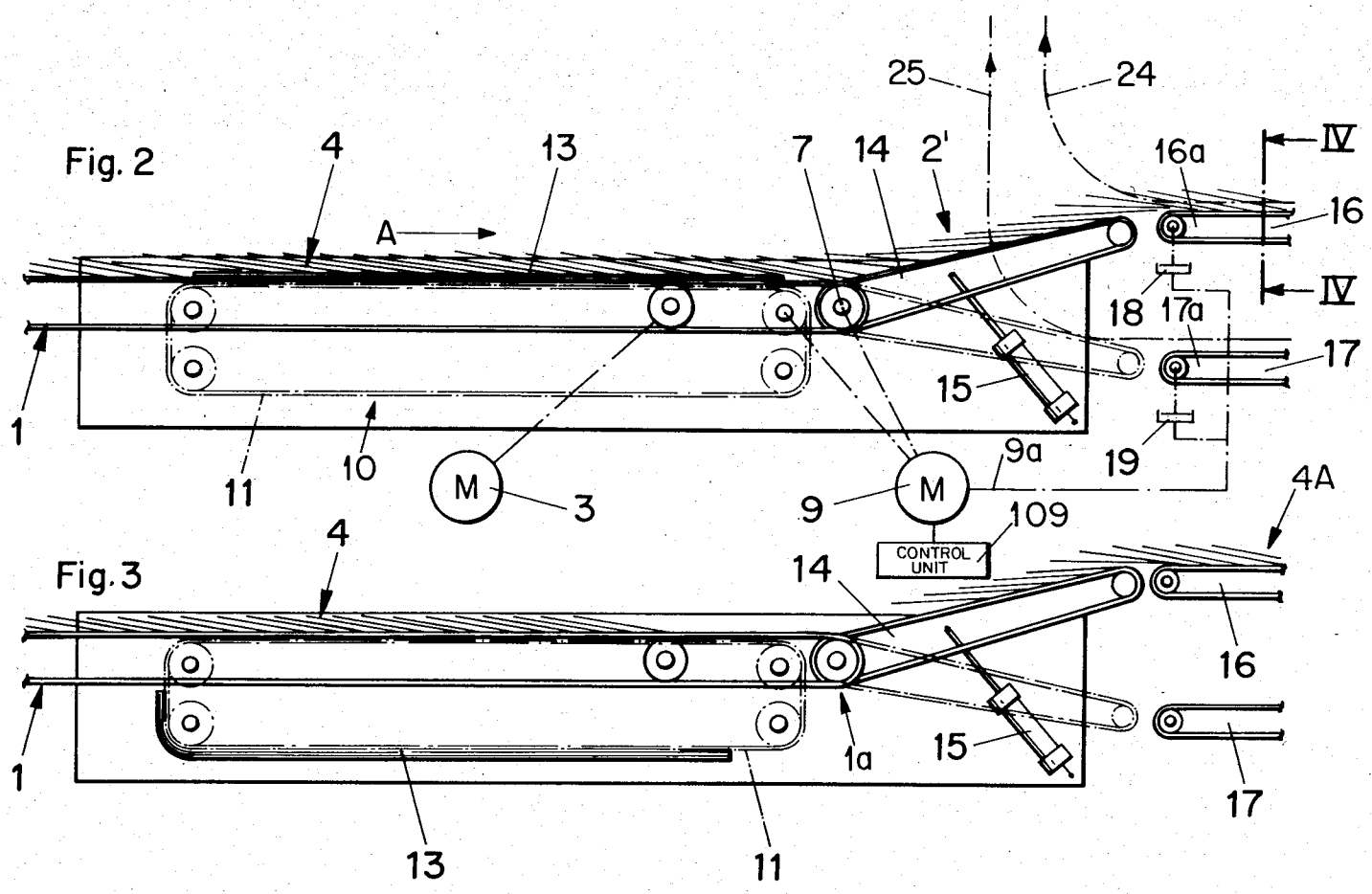
FIG. 2 is a similar elevational view of a modified apparatus wherein the means for receiving the separated sections of the continuous stream comprises several discrete conveyors.
FIG. 3 illustrates the structure of FIG. 2 but with a section fully separated from the remainder of the stream.
Figure 4:
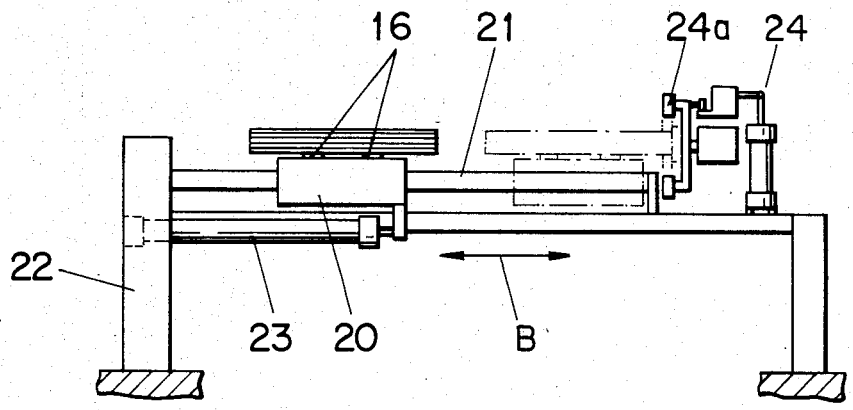
FIG. 4 is a transverse vertical sectional view as seen in the direction of arrows from the line IV—IV of FIG. 2.

FIG. 2, 3 and 4 illustrate a modified apparatus wherein all such parts which are identical with or clearly analogous to the corresponding parts of the apparatus of FIG. 1 are denoted by similar reference characters. The construction of the first conveyor 1 and accelerating device 10 is the same as described in connection with FIG. 1. The second conveyor 2' comprises a switching device 14 which is an endless belt or band conveyor mounted on a frame which is pivotable about the axis of the shaft 7 between the solid-line and phantom-line positions of FIG. 2. The means for pivoting the switching device 14 between such end positions comprises a fluid-operated (e.g., pneumatic) double-acting cylinder and piston unit 15.

The second conveyor 2' further comprises two endless belt or band conveyors 16 and 17. The receiving end 16*a* of the conveyor 16 is adjacent to the discharge end of the switching device 14 when the latter assumes the solid-line position of FIG. 2, and the receiving end 17*a* of the conveyor 17 is adjacent to the discharge end of the switching device 15 when the latter assumes the phantom-line position of FIG. 2. The length of the upper reaches of the conveyors 16, 17 at least matches the selected length of a section 4A. A clutch 18 is provided to selectively couple the output element 9*a* of the motor 9 with the driver pulley for the conveyor 16, and a similar clutch 19 is provided to selectively couple the driver pulley for the conveyor 17 with the output element 9*a* of the motor 9.

As shown in FIG. 4, the pulleys for the upper conveyor 16 are mounted on a carriage 20 which is reciprocable along horizontal guides 21 mounted in a frame 22 and extending at right angles to the direction indicated by the arrow A shown in FIG. 2. A fluid-operated (e.g., pneumatic) motor 23 is provided to move the carriage 20 back and forth in directions indicated by the double-headed arrow B between the solid-line and the phantom-line positions of FIG. 4. The pulleys for the lower conveyor 17 of FIG. 2 are mounted on a second carriage which is identical with or analogous to the carriage 20 of FIG. 4, and such second carriage is also reciprocable in directions indicated by the double-headed arrow B between two end positions in one of which the conveyor 17 can recieve sheets 4*a* from the switching device 14 and in the other of which the conveyor 17 is remote from the device 14. The arrangement is such that the conveyor 16 assumes one of its end positions (of registry with the switching device 14) when the conveyor 17 assumes the other end position, and vice versa.

When the carriage 20 for the conveyor 16 assumes the phantom-line position of FIG. 4, the sheets 4*a* of a section 4A on such conveyor are engaged by the grippers 24 of a further conveyor which advances the thus engages section 4A in a direction toward the observer of FIG. 4, i.e., counter to the direction which is indicated by the arrow A. It will be noted that the carriage 20 constitutes a third conveyor which diverts sections 4A on the conveyor 16 from the second path into and moves such sections sideways along a third path extending at right angles to the first and second paths, and that the conveyor 24 including the grippers 24*a* is arranged to advance the diverted sections 4A along a fourth path which is or may be parallel to the first path but along which the sheets 4*a* move in a direction counter to that which is indicated by the arrow A. The system for transporting sections 4A which are transferred onto the upper reach of the conveyor 17 is analogous. The grippers 24*a* of FIG. 4 can constitute elements of a transporting unit of the type disclosed in Swiss Pat. No. 322,276 and manufactured and sold by the Swiss firm Daverio & Co. AG, Zürich. Such transporting unit can deliver sheets to one or more consumers, not shown. The conveyor 25, which corresponds to the conveyor 24 but serves to receive sections 4A which are delivered by the conveyor 18, is denoted in FIG. 2 by a phantom line.

The mode of operation of the apparatus which includes the structure of FIGS. 2 to 4 is as follows:

At first, the conveyor of the switching device 14 is driven at the speed M1, the same as the conveyors 1 and 16 (it is assumed that the unit 15 maintains the switching device 14 in the solid-line position of FIG. 2). Thus, the leader of the stream 4 can advance with the upper reach 1*b* of the conveyor 1, with the upper reach of the endless conveyor of the switching device 14, and with the upper reach of the conveyor 16 to enter one of the two second paths defined by the conveyor 2'.

When the entire rubber pad 13 of the chain conveyor 11 of the accelerating device 10 enters the first path, the control unit 109 accelerates the motor 9 to the second speed M2 whereby the motor 9 accelerates the conveyor 11, the conveyor of the switching device 14 and (through the medium of the then engaged clutch 18) the conveyor 16. This results in a very smooth and predictable separation of a section 4A from the leader of the remaining portion of the stream 4. The motor 9 is decelerated back to the speed M1 as soon as the trailing end of the freshly formed section 4A advances beyond the discharge end 1*a* of the conveyor 1. The fresh leader of the stream 4 then advances toward the discharge end 1*a* while the trailing end of the freshly formed section 4A advances with the upper reach of the conveyor on the switching device 14 and toward and onto the receiving end of the conveyor 16. This is shown in FIG. 3. As soon as the trailing end of the section 4A advances beyond the conveyor of the switching device 14, the unit 15 is actuated to pivot the switching device 14 to the phantom-line position of FIG. 2. This means that the leader of the stream 4 then advances onto the switching device 14 and toward and onto the upper reach of the conveyor 17 which is then in register with the switching device. The speed of the motor 9 is again increased from M1 to M2 as soon as the entire pad 13 of the chain conveyor 11 enters the first path so that the apparatus separates from the stream 4 a second section 4A which is transferred into the second path defined by the conveyor 17 while the leader of the remainder of the stream 4 advances toward the discharge end 1*a* of the conveyor 1. The speed of the motor 9 is then again reduced to M1 as soon as the entire section 4A is transferred onto the upper reach of the conveyor 17, the unit 15 pivots the switching device 14 back to the solid-line position of FIG. 2 and the apparatus is ready to form a further section 4A which is transferred onto the conveyor 16.

While the conveyor 17 is in the process of receiving a section 4A, the motor 23 shifts the carriage 20 and the conveyor 16 (with a full-length section 4A thereon) from the solid-line to the phantom-line position of FIG. 4 so that the sheets 4*a* of such section enter the range of grippers 24*a* forming part of the conveyor 24 which advances the sheets counter to the direction indicated by the arrow A toward one or more consumers. It goes without saying that the clutch 18 is disengaged before the motor 23 is started to move the carriage 20 from the solid-line position to the phantom-line position of FIG. 4 and thereupon back to the solid-line position.

As mentioned above, the phantom line 25 denotes in FIG. 2 schematically the conveyor which receives sections 4A from the conveyor 17 on the second carriage. Since the conveyors 24, 25 transport the sections 4A counter to the direction which is indicated by the arrow A, the trailing end of each section 4A which is held by the grippers 24*a* of the conveyor 24 or 25 becomes the leader. This is often desirable when the sheets of the stream 4 are not delivered to the conveyor 1 immediately from a folding machine but rather from a first-in-last-out reservoir preceding the folding machine. It is assumed here that each sheet 4 has two halves which are folded over each other. The provision of a first-in-last-out reservoir is customary in plants which assemble newspapers. The aforementioned reservoir can temporarily store inserts which must be stuffed into the major portions of newspapers prior to stacking and baling of finished newspapers. The conveyors 24, 25 then deliver such inserts to the stuffing machines, e.g., to machines of the type disclosed in commonly owned U.S. Pat. No. 4,116,427. A suitable sheet folding apparatus is disclosed in commonly owned U.S. Pat. No. 4,221,373 and a suitable stacking or baling machine is disclosed in commonly owned U.S. Pat. No. 4,090,441. A first-in-last-out reservoir is disclosed in commonly owned copending application Ser. No. 469,925 filed Feb. 25, 1983 by Heinz Linder.

It will be appreciated that the mode of operation of the carriage which cooperates with the conveyor 17 and of the conveyor 25 which cooperates with such carriage is the same as described in connection with the carriage 20 and conveyor 24. The clutch 19 is engaged when the conveyor 17 is about to receive a section 4A, and the clutch 18 is engaged when a section 4A is to be transferred onto the conveyor 16. All operations can be synchronized and initiated by suitable programming means of the unit 109. The exact construction and mode of operation of such programming means form no part of the present invention.

The conveyor 16 or 17 is brought to an immediate halt when the respective clutch 18 or 19 is disengaged (e.g., in response to a signal from the control unit 109). This means that the conveyor 16 or 17 is at a standstill when the respective carriage 20 moves in one of the directions which are indicated by the arrow B in order to move a section 4A and the respective conveyor 16 or 17 toward the associated conveyor 24 or 25. The latter is then also at a standstill so that its grippers can properly engage the adjacent marginal portion of the freshly delivered section 4A.

The improved apparatus is susceptible of many additional modifications. For example, the conveyor 24 of FIG. 4 can constitute or comprise an endless belt conveyor having an upper reach which is coplanar with the upper reach of the conveyor 16. The carriage 20 is then used to move the upper reach of the conveyor 16 relative to (toward or away) from the upper reach of the endless conveyor of the transporting unit or vice versa. A pusher or platform is then used to transfer a full section 4A of sheets 4*a* from the upper reach of the conveyor 16 onto the upper reach of the conveyor 24.

In accordance with a further modification, the conveyors 16 and 17 need not be moved sideways (by carriages or the like). Instead, each of the conveyors 24, 25 comprises two sets of jaws which descend from above and engage the respective marginal portions of the sheets forming a section 4A on the conveyor 16 or 17 to lift the entire section off the upper reach of the conveyor 16 or 17 prior to transport of the thus lifted section in a desired direction. The just mentioned conveyors 24, 25 can comprise pairs of endless conveyors each of which carries a set of jaws for the respective marginal portion of the section 4A on the conveyor 16 or 17.

The just discussed modifications of the conveyors 24, 25 are shown and fully described in the aforementioned commonly owned copending application Ser. No. 610,400 filed May 15, 1984.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for separating discrete sections of selected length from the leader of a stream of sheets, particularly from a stream of partially overlapping paper sheets, comprising first conveyor means arranged to advance the stream in a predetermined direction along a first elongated path, said conveyor means having a discharge end; second conveyor means defining at least one second elongated path and having a receiving end downstream of said discharge end, as considered in said direction; accelerating means adjacent to a portion of said first path ahead of said discharge end and arranged to repeatedly accelerate those portions of the leader of the stream in said first path whose length at most matches said selected length; first drive means for moving said first conveyor means at a first speed; and second drives means for alternately moving (a) said second conveyor means and said accelerating means in said direction at a higher second speed so that said accelerating means separates the portion of the leader in said first path from the remainder of the stream and advances the thus obtained section into said second path where the section is advanced by said second conveyor means, and (b) said second conveyor means at a third speed which is lower than said second speed and at least approximates said first speed with attendant deceleration of the section in said second path, said second drive means being arranged to move said accelerating means at said third speed jointly with said second conveyor means.

2. The apparatus of claim 1, wherein the length of said second path at least matches said selected length.

3. The apparatus of claim 1, wherein said accelerating means comprises an endless conveyor including a stream-contacting portion which extends into said first path while advancing along said portion of said first path to thereby engage and entrain the adjacent sheets of the stream, said second drive means being arranged to move said endless conveyor at said second speed while said portion of said endless conveyor extends into said portion of said first path.

4. The apparatus of claim 1, further comprising third conveyor means for diverting discrete sections from said second path into a third path and for moving the diverted sections along the third path in a second direction at least substantially normal to said predetermined direction.

5. The apparatus of claim 1, wherein said first path is at least substantially horizontal.

6. The apparatus of claim 1, wherein said accelerating means includes an endless conveyor having an elongated stream-contacting portion adjacent said portion of the first path.

7. The apparatus of claim 6, wherein said first conveyor means comprises an endless conveyor having an elongated reach defining said first path.

8. The apparatus of claim 7, wherein said reach of the endless conveyor of said first conveyor means includes a portion extending along and being parallel to said portion of the endless conveyor of said accelerating means.

9. Apparatus for separating discrete sections of selected length from the leader of a stream of sheets, particularly from a stream of partially overlapping paper sheets, comprising first conveyor means arranged to advance the stream in a predetermined direction along a first elongated path, said conveyor means having a discharge end; second conveyor means defining two second elongated paths and having a receiving end downstream of said discharge end, as considered in said direction; accelerating means adjacent to a portion of said first path ahead of said discharge end and arranged to repeatedly accelerate those portions of the leader of the stream in said first path whose length at most matches said selected length; first drive means for moving said first conveyor means at a first speed; second drive means for alternately moving (a) said second conveyor means and said accelerating means in said direction at a higher second speed so that said accelerating means separates the portion of the leader in said first path from the remainder of the stream and advances the thus obtained section into one of said second paths where the section is advanced by said second conveyor means, and (b) said second conveyor means at a third speed which is lower than said second speed with attendant deceleration of the section in said second path; and switching means interposed between said first path and said second paths and movable between a first position in which a section advances therealong into one of said second paths and a second position in which a section advances therealong into the other of said second paths.

10. The apparatus of claim 9, wherein the length of each of said second paths at least matches said selected length.

11. The apparatus of claim 9, wherein said second conveyor means comprises two discrete conveyors each of which defines one of said second paths and further comprising means for selectively coupling said second drive means to one conveyor of said second conveyor means at a time.

12. Apparatus for separating discrete sections of selected length from the leader of a stream of sheets, particularly from a stream of partially overlapping paper sheets, comprising first conveyor means arranged to advance the stream in a predetermined direction along a first elongated path, said conveyor means having a discharge end; second conveyor means defining at least one second elongated path and having a receiving end downstream of said discharge end, as considered in said direction; accelerating means adjacent to a portion of said first path ahead of said discharge end and arranged to repeatedly accelerate those portions of the leader of the stream in said first path whose length at most matches said selected length; first drive means for moving said first conveyor means at a first speed; second drive means for alternately moving (a) said second conveyor means and said accelerating means in said direction at a higher second speed so that said accelerating means separates the portion of the leader in said first path from the remainder of the stream and advances the thus obtained section into said second path where the section is advanced by said second conveyor means, and (b) said second conveyor means at a third speed which is lower than said second speed with attendant deceleration of the section in said second path; and third conveyor means for diverting discrete sections from said second path into a third path and for moving the diverted sections along the third path in a second direction at least substantially normal to said predetermined direction, said third conveyor means comprising means for moving a portion of said second conveyor means in said second direction.

13. Apparatus for separating discrete sections of selected length from the leader of a stream of sheets, particularly from a stream of partially overlapping paper sheets, comprising first conveyor means arranged to advance the stream in a predetermined direction along a first elongated path, said conveyor means having a discharge end; second conveyor means defining at least one second elongated path and having a receiving end downstream of said discharge end, as considered in said direction; accelerating means adjacent to a portion of said first path ahead of said discharge end and arranged to repeatedly accelerate those portions of the leader of the stream in said first path whose length at most matches said selected length; first drive means for moving said first conveyor means at a first speed; second drive means for alternately moving (a) said second conveyor means and said accelerating means in said direction at a higher second speed so that said accelerating means separates the portion of the leader in said first path from the remainder of the stream and advances the thus obtained section into said second path where the section is advanced by said second conveyor means, and (b) said second conveyor means at a third speed which is lower than said second speed with attendant deceleration of the section in said second path; third conveyor means for diverting discrete sections from said second path into a third path and for moving the diverted sections along the third path in a second direction at least substantially normal to said predetermined direction; and fourth conveyor means for moving diverted sections along a fourth path in a third direction at least substantially counter to said predetermined direction.

14. The apparatus of claim 13, wherein said fourth conveyor means comprises means for gripping the sheets of sections in said fourth path.

* * * * *